US007503091B2

(12) United States Patent
White, Jr. et al.

(10) Patent No.: US 7,503,091 B2
(45) Date of Patent: Mar. 17, 2009

(54) AUTOMATIC WINDOW CLEANING APPARATUS

(76) Inventors: Clarence A. White, Jr., 2809 NE. 101 1st Ct., Vancouver, WA (US) 98662; Thomas E. Kirven, 4277 NE. 43rd St., Neotsu, OR (US) 97364

( * ) Notice: Subject to any disclaimer, the term of this patent is extended or adjusted under 35 U.S.C. 154(b) by 410 days.

(21) Appl. No.: 11/239,873

(22) Filed: Sep. 29, 2005

(65) Prior Publication Data

US 2007/0044259 A1 Mar. 1, 2007

Related U.S. Application Data

(60) Provisional application No. 60/710,778, filed on Aug. 23, 2005.

(51) Int. Cl.
*A47L 1/02* (2006.01)

(52) U.S. Cl. ..... 15/103; 15/250.11; 15/98

(58) Field of Classification Search ..... 15/250.11, 15/103, 50.1, 50.3, 52.1, 98
See application file for complete search history.

(56) References Cited

U.S. PATENT DOCUMENTS

| | | | | |
|---|---|---|---|---|
| 1,197,763 | A | 9/1916 | Plotnitzky | |
| 1,766,550 | A | 6/1930 | Schubert | |
| 1,922,078 | A | 8/1933 | Curry | |
| 2,563,696 | A | 8/1951 | Wayne | |
| 2,693,609 | A | 11/1954 | Briceno | |
| 2,740,151 | A | 4/1956 | Wayne | |
| 3,298,052 | A | 1/1967 | Wolfe | |
| 3,354,494 | A | 11/1967 | Rischman | |
| 3,378,875 | A | 4/1968 | Kern | |
| 3,461,476 | A | 8/1969 | North | |
| 3,999,242 | A | 12/1976 | Maruyama et al. | |
| 4,257,138 | A | 3/1981 | Clements et al. | |
| 5,086,533 | A | 2/1992 | Kitahara | |
| 5,323,508 | A | 6/1994 | Sheldrake | |
| 5,699,576 | A | 12/1997 | Sohaiby | |
| 6,090,221 | A * | 7/2000 | Gan et al. | 134/21 |
| 6,170,109 | B1 * | 1/2001 | Jesadanont et al. | 15/50.3 |
| 6,601,256 | B2 | 8/2003 | Lee | |
| 6,851,156 | B1 | 2/2005 | Hairaton | |

* cited by examiner

*Primary Examiner*—Shay L Karls
(74) *Attorney, Agent, or Firm*—Klarquist Sparkman, LLP

(57) ABSTRACT

A window cleaning apparatus includes a cleaning mechanism that is mounted for movement relative to a window. The cleaning mechanism includes one or more cleaning tools, such as a brush and a wiper blade, and an onboard hydro-mechanical motor that provides the motive force for moving the cleaning mechanism. The cleaning mechanism has first and second drive wheels that engage first and second upright tracks, respectively, mounted on opposite sides of the window. The motor receives pressurized water from a water source (e.g., a water line of the building) and derives output mechanical power for rotating the drive wheels, which move along the tracks.

12 Claims, 11 Drawing Sheets

AUTOMATIC WINDOW CLEANING APPARATUS

CROSS REFERENCE TO RELATED APPLICATION

This application claims the benefit of U.S. Provisional Application No. 60/710,778, filed Aug. 23, 2005, which is incorporated herein by reference.

FIELD

The present application concerns an apparatus for automatically cleaning windows, for example, the outside of windows on buildings.

BACKGROUND

The exterior surfaces of windows at high elevations (e.g., the windows of a skyscraper) typically are manually cleaned by a worker standing on a vertically movable scaffold suspended by cables or rope secured to the roof of the building. As can be appreciated, this is dangerous and time-consuming work.

Several designs have been proposed for devices that accomplish washing of windows without requiring a worker to manually wash the exterior window surface from a position outside of the building. Many of such devices have failed to provoke much interest with architects and engineers as they require a worker to position him/herself outside of the building to set up the window washing apparatus. Other, permanently installed devices have been proposed, but some such proposals utilize extremely bulky and unsightly devices. Finally, many such proposed devices are so complex that it is economically impractical to permanently mount a washing device on each window of a building.

Accordingly, there is a continuing need for new and improved devices for washing the exterior surfaces of windows.

SUMMARY

The present disclosure concerns an automatic window cleaning apparatus that can be permanently installed on the exterior of a building. When activated, the cleaning apparatus automatically cleans the exterior window surface so as to eliminate the need to manually wash the window from a position outside of the building.

In particular embodiments, the window cleaning apparatus includes a cleaning mechanism that is mounted for movement relative to the window. The cleaning mechanism includes one or more cleaning tools, such as a brush and a wiper blade, and an onboard hydro-mechanical motor that provides the motive force for moving the cleaning mechanism relative to the window. The cleaning mechanism has first and second drive wheels that engage first and second upright tracks, respectively, mounted on opposite sides of the window. The motor receives pressurized water from a water source (e.g., a water line of the building) and outputs mechanical power for rotating the drive wheels, which move along the tracks, thereby moving the brush and the wiper blade across the window surface.

Advantageously, the cleaning mechanism does not require electricity to operate, which greatly simplifies installation since electrical wiring to the cleaning mechanism is not needed. While an electrically actuated control valve desirably is used to control the flow of pressurized water to the motor, such a valve can be installed at any convenient location inside the building. Another advantage is that water discharged from the motor is sprayed onto the window surface, which further simplifies installation and construction of the device since a separate mechanism for wetting the window surface is not required.

Another advantage of the apparatus is that it does not utilize bulky or unsightly devices mounted to the sides of the window, as in conventional devices. The tracks can be mounted directly to the casing of the window and do not have any moving parts, which further simplifies installation. Additionally, the casing below the window can be formed with small recess to receive and hide the cleaning mechanism from view when the apparatus is not in use.

In certain embodiments, each track is formed with a generally elliptical recessed portion extending lengthwise of the track and a plurality of lugs disposed in the recessed portion and spaced lengthwise of the track. The drive wheels therefore move in an endless, continuous path around the lugs of the tracks to alternately move the cleaning mechanism upwardly from the bottom to the top of the window, and then downwardly from the top to the bottom of the window.

In a representative embodiment, a window cleaning apparatus for cleaning a window comprises at least one cleaning tool mounted for movement relative to the window. A hydro-mechanical motor is operatively connected to the cleaning tool and is configured to receive pressurized water from a water source and derive output power from the pressurized water such that when the motor is fluidly connected to the water supply, the motor provides output power to cause the cleaning tool to move across the window surface.

In another representative embodiment, a window cleaning apparatus for cleaning a window comprises first and second, vertically oriented tracks mounted on opposite sides of the exterior of the window. A cleaning mechanism located on the exterior of the window comprises a motor and at least one cleaning tool. The cleaning mechanism is configured to movingly engage the first and second tracks, respectively, such that operation of the motor causes the cleaning tool and the motor to move vertically relative to the window.

In another representative embodiment, a window cleaning apparatus for cleaning a window comprises wiping means for wiping a cleaning liquid from the exterior surface of the window and non-electric drive means for automatically moving the wiping means relative to the window.

In another representative embodiment, a method is provided for cleaning a window with a water-powered cleaning mechanism. The method comprises spraying water onto the exterior surface of the window and supplying pressurized water to a hydro-mechanical motor of the cleaning mechanism, causing the cleaning mechanism to move across the exterior window surface, thereby removing water from the exterior window surface.

The foregoing and other objects, features, and advantages will become more apparent from the following detailed description, which proceeds with reference to the accompanying figures.

DETAILED DESCRIPTION

As used herein, the singular forms "a," "an," and "the" refer to one or more than one, unless the context clearly dictates otherwise.

Figure 1:
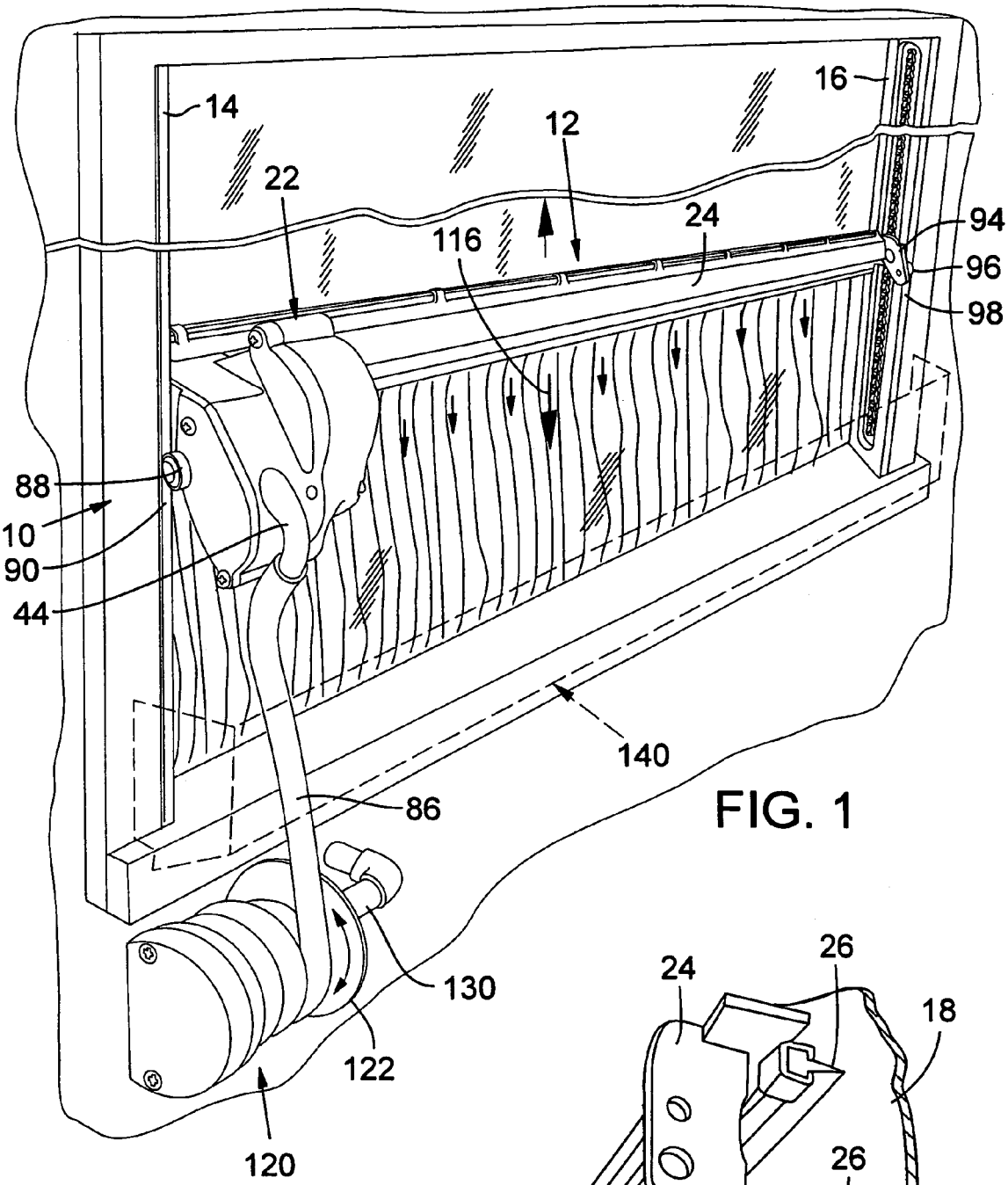
FIG. 1 is a perspective view of a window cleaning apparatus installed on the exterior casing of a window, according to one embodiment.
Figure 2:
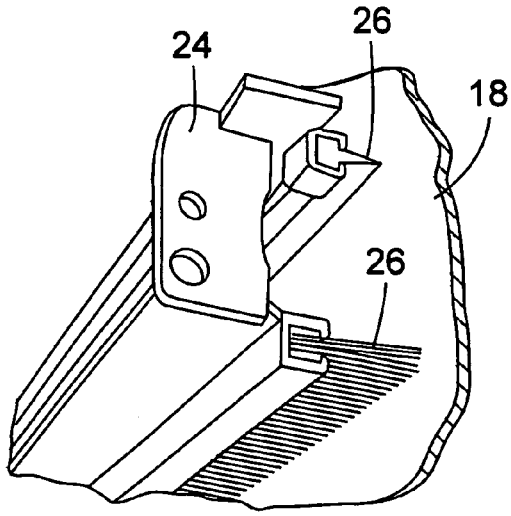
FIG. 2 is an enlarged, fragmentary perspective view of a cleaning mechanism of the apparatus supporting a wiper blade and a brush for cleaning the window.

As used herein, the term "includes" means "comprises." Referring first to FIG. 1, there is shown a window cleaning apparatus, indicated generally at 10, according to one embodiment. The window cleaning apparatus 10 generally includes a cleaning mechanism 12 mounted for vertical movement on upright, first and second tracks 14, 16 (also referred to herein as rails). The tracks 14, 16 are mounted on opposite sides of the exterior of a window 18. For example, the tracks 14, 16 can be mounted to the opposing, vertical surfaces of the window casing 20 as shown in the illustrated embodiment. The cleaning mechanism 12 spans the width of the window 18 with each end portion of the cleaning mechanism engaging one of the tracks 14, 16. The cleaning mechanism 12 is configured to move upwardly and downwardly substantially the entire height of the window 18, as described in detail below.

A panel 40 can be mounted at the base of the window to hide the cleaning mechanism 12 from view when the apparatus is not being used. Alternatively, the bottom of the window casing can be formed with a cavity sized to receive the cleaning mechanism 12. When the apparatus is not being used, the cleaning mechanism 12 is retracted into the cavity and hidden from view.

While in the illustrated embodiment the tracks 14, 16 extend substantially the entire height of the window, this is not a requirement. In other applications, for example, the tracks can extend less than the height of the window if only a portion of the exterior window surface need be cleaned.

In an alternative embodiment, the tracks can be mounted to the upper and lower horizontal surfaces of the window casing so as to support the cleaning mechanism in a vertical position spanning the height of the window. In this alternative embodiment, the cleaning mechanism is supported for horizontal movement relative to the window (i.e., movement of the cleaning mechanism left to right and vice versa across the window surface). In yet another embodiment, the tracks 14, 16 can be integrally formed as part of the window casing 20.

The cleaning mechanism 12 in the illustrated configuration includes a hydro-mechanical motor 22 and an elongate support bracket 24 connected to the motor 22 and extending widthwise of the window 18. The bracket 24 supports one or more cleaning tools, such as the illustrated wiper blade 26 ("squeegee") and brush 28. Although less desirable, in alternative embodiments, the cleaning mechanism 12 can include a wiper blade but not a brush. Other types of cleaning tools also can be used in lieu of or in addition to the illustrated wiper blade 26 and brush 28. In one implementation, for example, brush 28 can be replaced with a rotating brush that is supported for rolling contact on the surface of the window. In another implementation, wiper blade 26 can be replaced with a roller supported for rolling contact on the window surface and covered with an absorbent material that absorbs water from the window surface.

Figure 4:
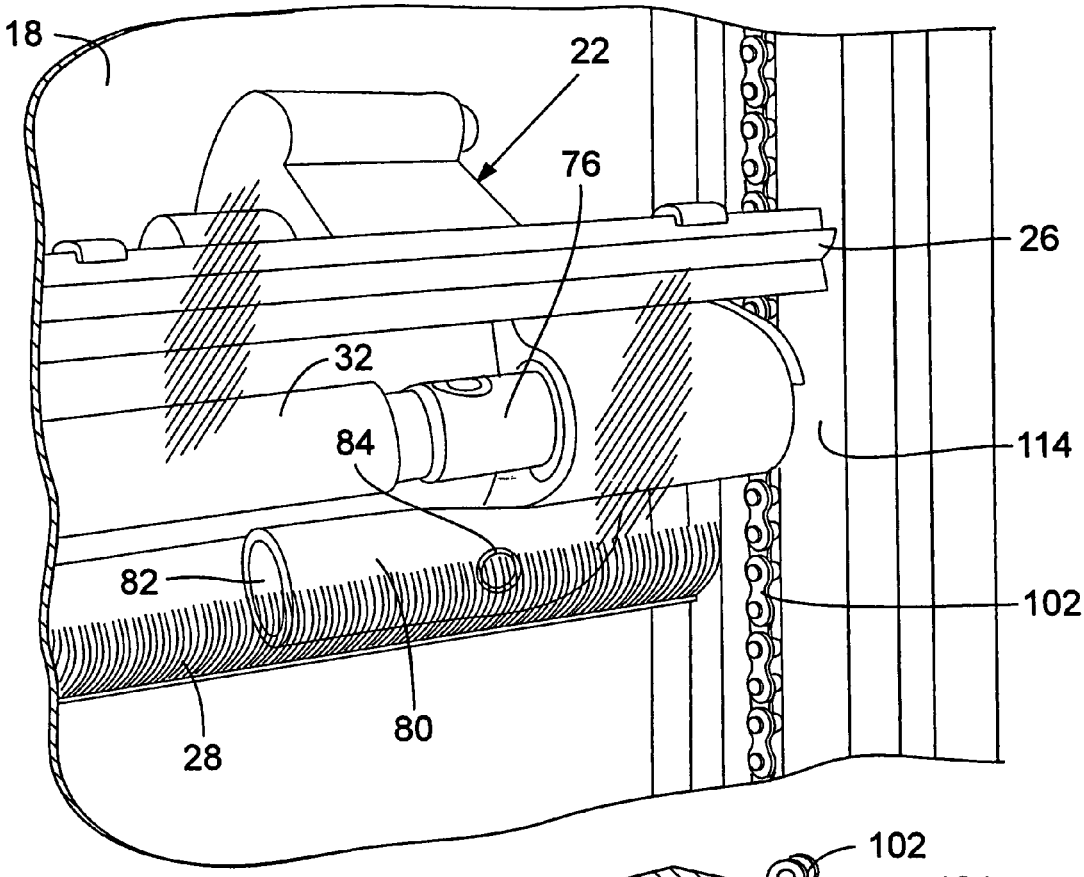
FIG. 4 is an enlarged, fragmentary perspective view of the window cleaning apparatus showing the motor, the drive shaft, the wiper blade, and the brush of the cleaning mechanism as viewed from inside the window.
Figure 5:
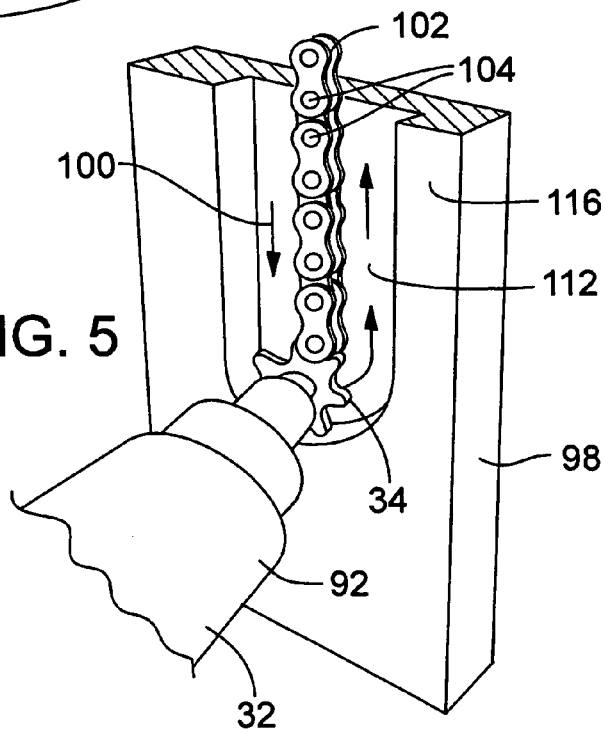
FIG. 5 is an enlarged, fragmentary perspective view of the drive shaft and the lower portion of one of the tracks, showing one of the drive wheels engaging the chain of the track.
Figure 6:
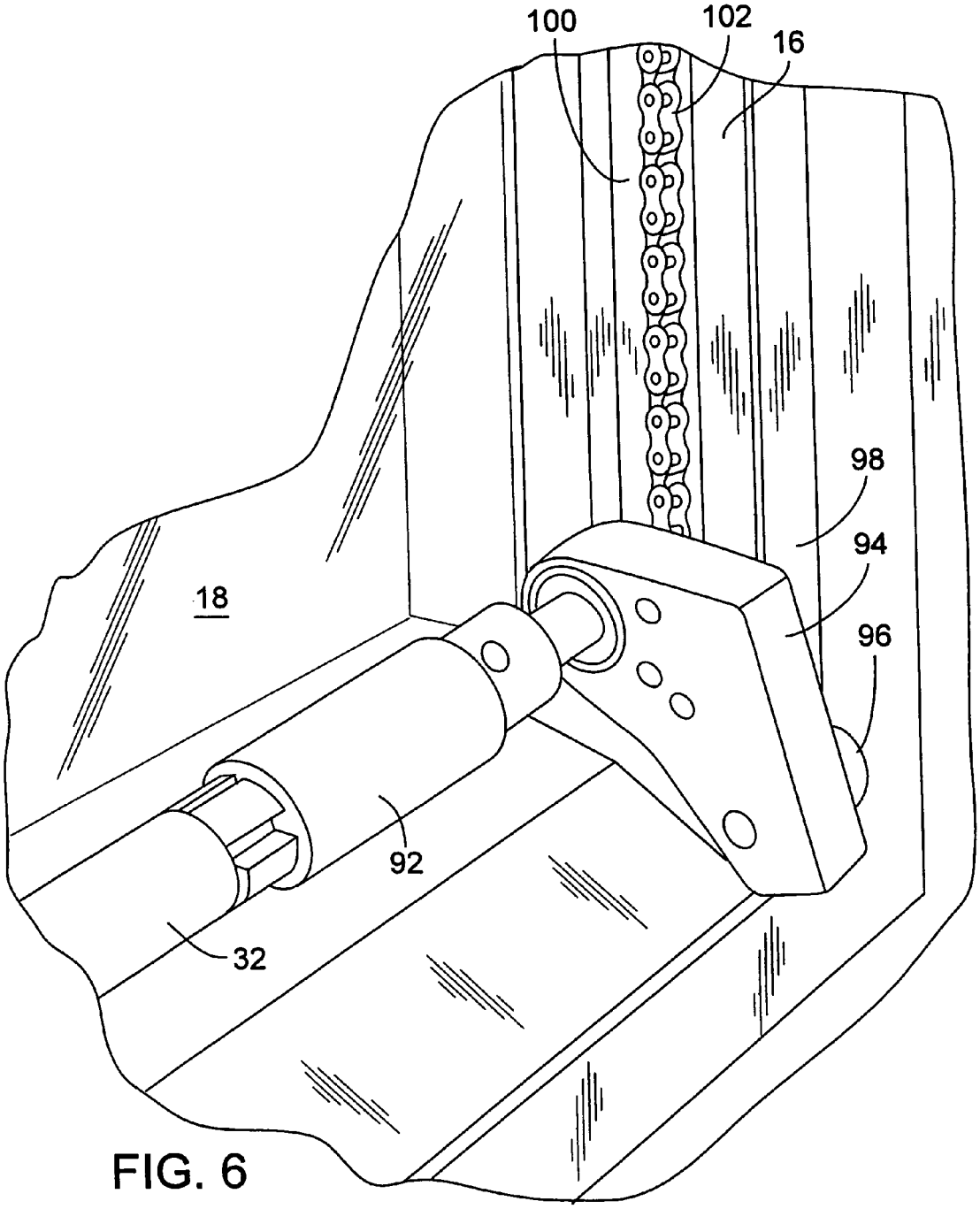
FIG. 6 is an enlarged, fragmentary perspective view of the window cleaning apparatus showing the drive shaft, the support member, and the lower portion of one of the tracks.

The motor 22 receives pressurized water from a water source (e.g., a water line of the building on which the apparatus is installed) and is operable to derive output power from the pressurized water for moving the cleaning apparatus 12 relative to the tracks 14, 16. The cleaning mechanism 12 includes a first drive wheel, or sprocket, 30 that engages the first track 14 (FIGS. 7-9), an elongate drive shaft 32 extending from the motor 22 (FIG. 4 and 6), and a second drive wheel, or sprocket 34, that is connected to the drive shaft 32 and engages the second track 16 opposite the first drive wheel 30 (FIGS. 5 and 6). When pressurized water is supplied to the motor 22, the motor converts water pressure into mechanical power for rotating the drive wheels 30, 34, which in turn move along the tracks.

As best shown in FIGS. 10-13, the illustrated motor 22 includes a first casing portion 36, a second casing portion 38, and an end plate 40 secured to the first casing portion 36 opposite the second casing portion. End plate 40 is secured to the first casing portion 36 with a screw (not shown) extending through end plate 40 and tightened into a threaded hole 142 in the first casing portion 36. The first casing portion 36 is formed with a chamber, or cavity, 88 in which there is disposed an impeller 42 formed with a plurality of angularly-spaced, curved impeller vanes 46. The first casing portion 36 is formed with a water inlet port 44 that directs pressurized water onto the impeller vanes 46, and thereby causing rotation of the impeller 42. The impeller 42 is secured to a shaft 48 extending through an opening in the first casing portion 36 into the second casing portion 38. The end of the shaft 48 opposite the impeller is connected to a drive gear 50. One or more annular bearings 52 disposed on the shaft 48 and covered by an elastomeric (e.g., neoprene) sleeve 144 function to support the shaft and assist in sealing the opening in the first casing portion 36. A set screw 146 in the second casing portion 38 retains the axial position of the impeller 42 and shaft 48.

Figure 13:
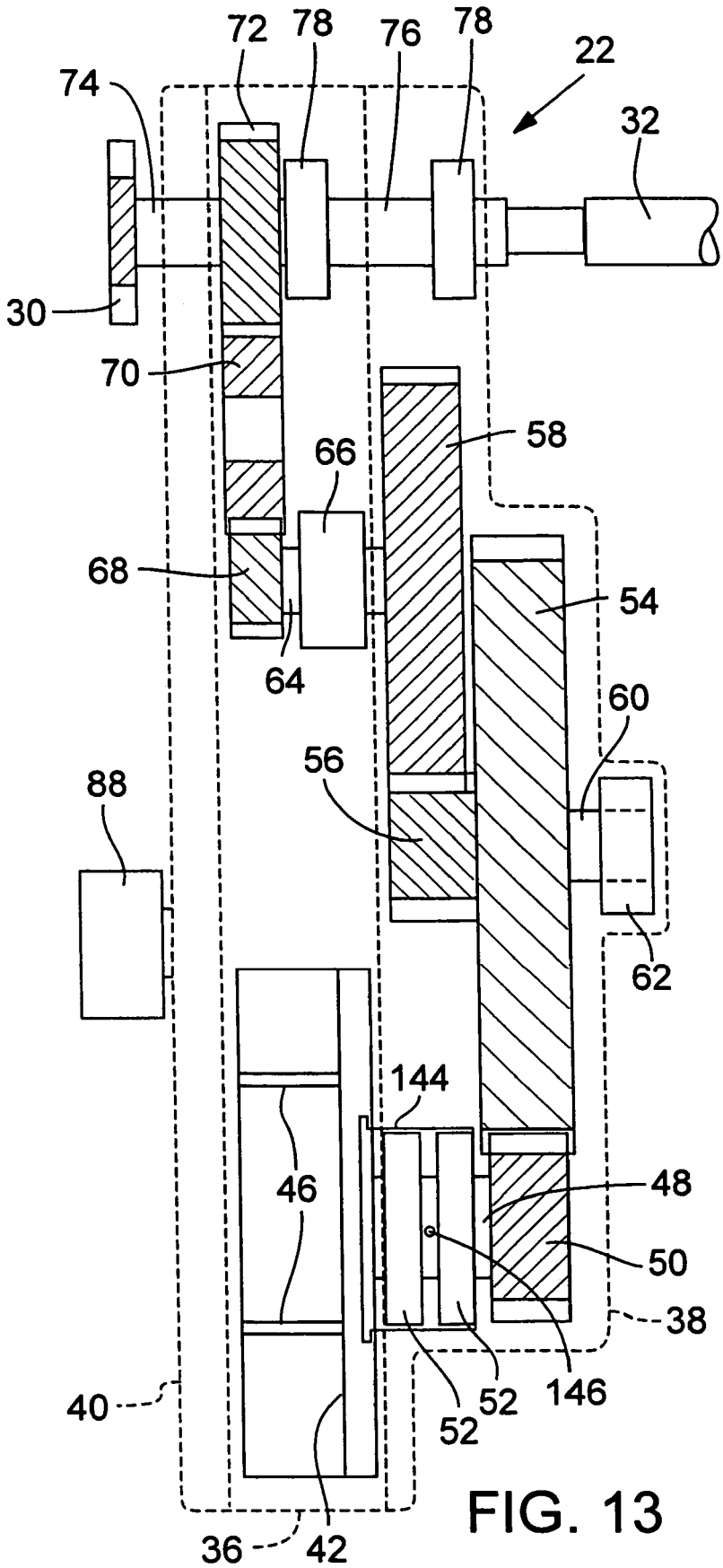
FIG. 13 is an enlarged sectional view of the motor.

The motor 22 houses a gear reducer comprising gears 54, 56, 58, 68, 70, and 72, which function to reduce the rotational speed between the impeller 42 and the drive wheels 30, 34. Gear 50 drivingly engages gear 54, which is connected to gear 56, which in turn drivingly engages gear 58. A shaft 60 connected to gear 54 is supported by an annular bearing 62 disposed in annular groove in the second casing portion 38. A shaft 64 is connected at one end to gear 58 and extends through an opening in the second casing portion 38 into the first casing portion 36. An annular bearing 66 disposed in an annular groove in the first casing portion 36 supports shaft 64. Gear 68 is connected to the end of shaft 64 opposite gear 58 and drivingly engages gear 70, which in turn drivingly engages gear 72. A shaft 74 connected to one side of gear 72 extends through end plate 40 and supports the first drive wheel 30. A shaft 76 connected to the opposite side of gear 72 extends through corresponding openings in the first and second casing portions 36, 38 and is connected to one end of the drive shaft 32. The opposite end of the drive shaft 32 is connected to the second drive wheel 34 (FIG. 5). Annular bearings 78 disposed in the first and second casing portions 36, 38 support shaft 76 (FIG. 13).

Gears 50, 54, 56, 58, 68, 70, and 72 transfer rotational movement of the impeller 42 to the first drive wheel 30 and to the second drive wheel 34 (through the drive shaft 32) at a reduced rotational speed. In particular embodiments, the gear ratio is about 32:1, although the gear ratio could be varied depending on the application. Other gear configurations as well as other techniques or mechanisms also can be used to reduce the rotational speed between the impeller 42 and the drive wheels 30, 34. For example, a pressure control valve (a manual or automatic valve) can be used to reduce the pressure of the water supplied to motor 22, and therefore reduce the rotational speed of the impeller 42. As another example, reduction of the rotational speed can be accomplished with a belt-and-pulley drive connecting the impeller to the drive wheels.

The inlet 44 of the motor 22 is connected to a flexible conduit 86 (FIGS. 1 and 3) (which can be, for example, plastic tubing), which is fluidly connectable to the pressurized water source. As best shown in FIG. 4, the first casing portion 36 of the motor 22 is formed with an outlet portion 80 in fluid communication with the chamber 88 of the first casing portion 36. The outlet portion 80 includes openings 82 and 84 positioned to discharge water from the motor onto the window surface. In use, water from the pressurized water source flows through conduit 86, inlet 44 and into chamber 88, where it is then discharged through the openings 82, 84 in the outlet portion 80. Water discharged through opening 82 is sprayed across the window surface toward the second track 16, while water discharged through opening 84 contacts the area of the window surface between the motor 22 and the first track 14. In an alternative embodiment, the outlet portion 80 can include an elongate extension portion that spans the width of the window between the tracks 14, 16 and is formed with a plurality of spaced-apart openings for spraying water onto the window surface.

Other types of hydro-mechanical motors also can be implemented in the cleaning apparatus. For example, the motor can include a reciprocating piston, rather than an impeller, that is activated with water pressure to provide motive power to the drive wheels 30, 34. In another embodiment, the cleaning mechanism 12 can include an electric motor that is battery operated or/and electrically connected to an electric circuit of the building on which the cleaning apparatus is installed.

While the illustrated embodiment utilizes an onboard motor (i.e., a motor that moves upwardly and downwardly with the cleaning mechanism 12), a stationary motor alternatively can be used. In one embodiment, for example, the cleaning apparatus includes a pair of movable chains or belts that supports the cleaning mechanism. A stationary motor, such as a hydro-mechanical motor or an electric motor, is operable to move the chains, and thereby the cleaning mechanism, upwardly and downwardly relative to the window. In this embodiment, the cleaning mechanism can include a discharge nozzle that is fluidly connected to the water source for spraying water onto the window surface.

Figure 7:
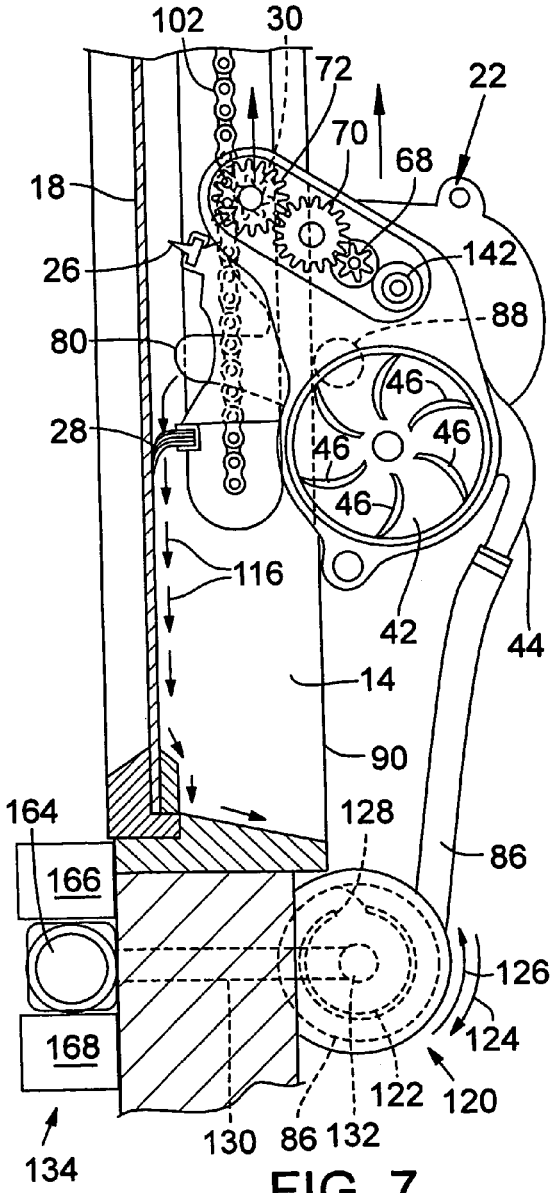
FIG. 7 is fragmentary side elevation view of the window cleaning apparatus and window, showing the cleaning mechanism moving upwardly relative to the window.
Figure 8:
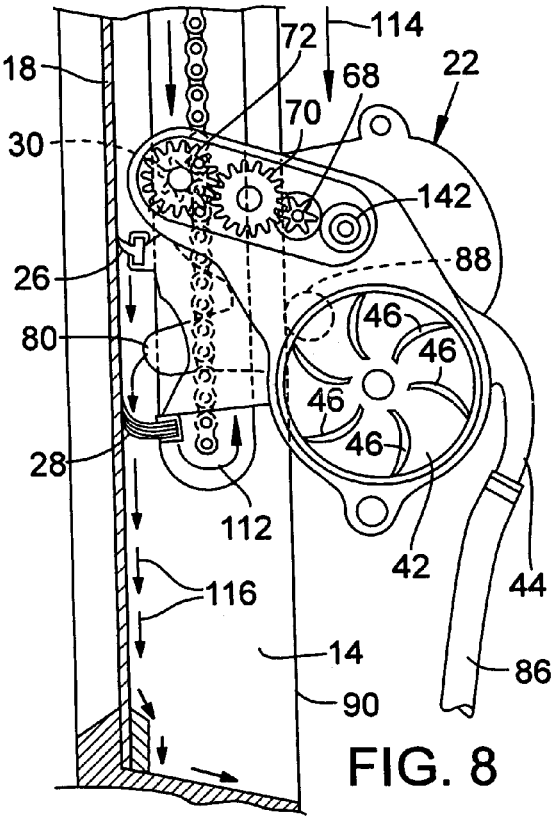
FIG. 8 is fragmentary side elevation view of the window cleaning apparatus and window, showing the cleaning mechanism moving downwardly relative to the window.

As best shown in FIGS. 1, 7 and 8, the motor 22 further includes a roller 88 that is supported for rolling contact with the vertical end surface 90 of the first track 14. As shown in FIG. 6, the drive shaft 32 includes a stepped end portion 92 adjacent the second track 16. End portion 92 extends through a support member 94 and is secured at its terminal end to the second drive wheel 34 (shown in FIG. 5). The support member 94 includes a roller 96 (FIG. 6) that is supported for rolling contact with the vertical end surface 98 of the second track 16.

Figure 9:
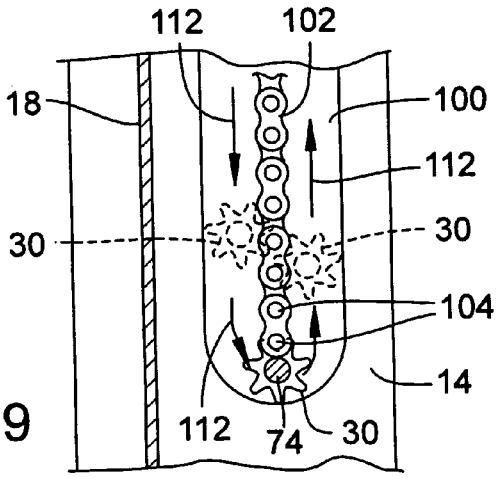
FIG. 9 is a fragmentary side elevation view of the lower portion of one of the tracks, showing the corresponding drive wheel traversing a path extending around the chain of the track.
Figure 10:
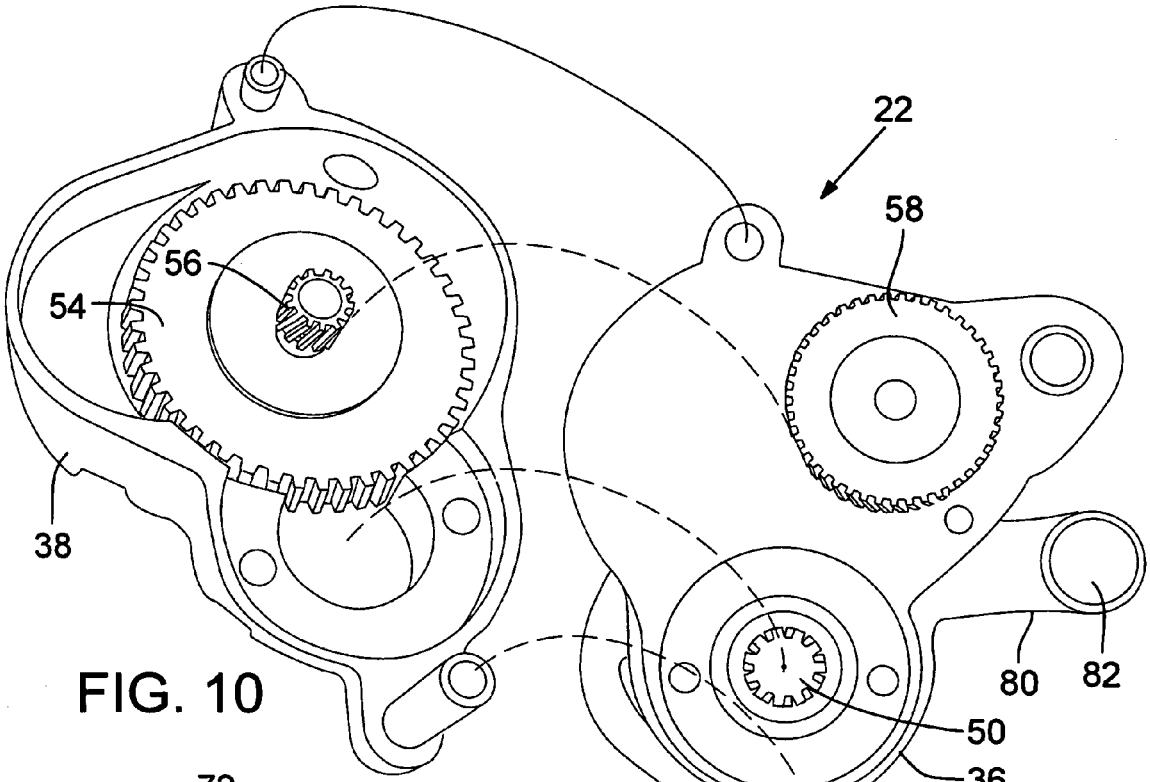
FIG. 10 is a perspective view showing the inside of each casing portion of the motor.
Figure 11:
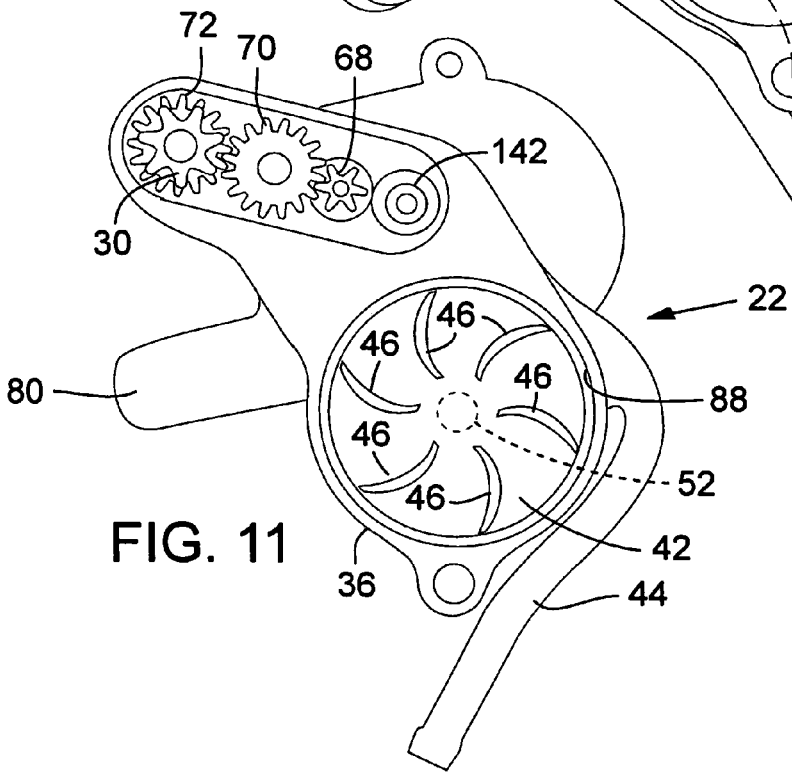
FIG. 11 is a side elevation view of the motor shown with the end plate removed.
Figure 12:
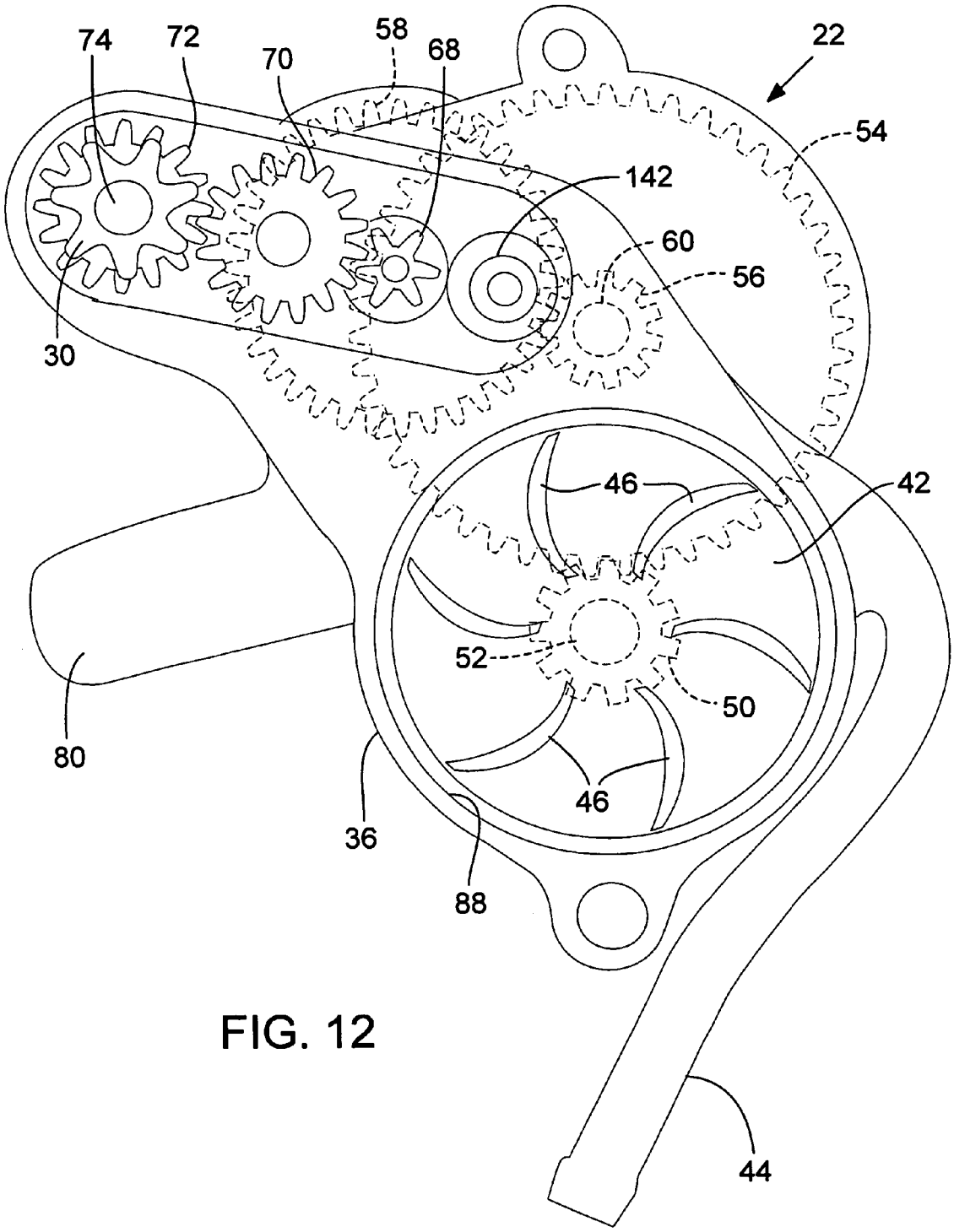
FIG. 12 is an enlarged, side elevation view of the motor showing the gear assembly housed inside the motor.

Each track 14, 16 in the illustrated configuration includes a generally elliptically shaped recessed portion 100 extending substantially the entire length of the tracks. Disposed in the recessed portion 100 of each track is a chain 102. As best shown in FIGS. 7-9, the first drive wheel 30 is disposed in the recessed portion 100 of the first track 14 and engages the pins 104 of the respective chain 102. Similarly, as best shown in FIG. 5, the second drive wheel 34 is disposed in the recessed portion 100 of the second track 16 and engages the pins 104 of the respective chain 102. In this manner, the pins 104 function as lugs for engagement with drive wheels 30, 34. Operation of the motor 22 produces rotational movement of the drive wheels 30, 34, which then move along the pins 104. The recessed portion 100 of each track defines an endless path for a drive wheel extending around the respective chain 102. Hence, the drive wheels 30, 34 can move in an endless, continuous path around the chains 102 (as indicated by arrows 112 in FIGS. 5, 8 and 9) to alternately move the cleaning mechanism upwardly from the bottom to the top of the window, and then downwardly from the top to the bottom of the window 18. Notably, it is not necessary to reverse the rotation of the motor to change the direction of movement of the cleaning mechanism.

Figure 3:
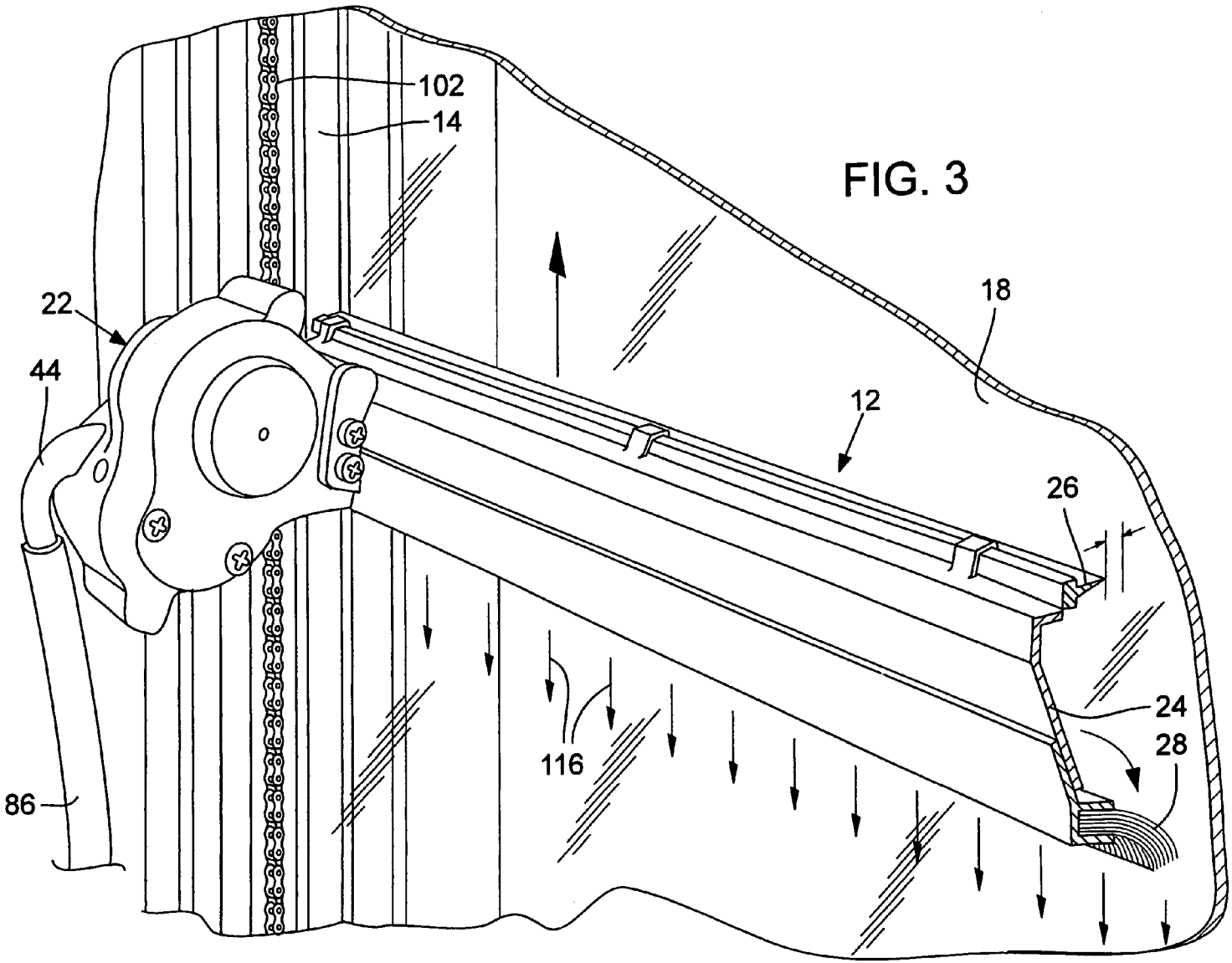
FIG. 3 is fragmentary perspective view of the window cleaning apparatus and window, showing the wiper blade retracted away from the window surface.

Water discharged from motor 22 contacts the exterior window surface in the area between the wiper blade 26 and the brush 28, forming a sheet of water flowing downwardly along the window surface, as indicated by arrows 116 (FIGS. 1 and 3). As shown in FIG. 7, as the cleaning mechanism 12 moves upwardly relative to the window 18, as indicated by arrows 118, the wiper blade 26 is spaced from the exterior window surface, while the brush 28 contacts the exterior window surface, wiping debris therefrom. At the top of the tracks, the drive wheels 30, 34 rotate over the top of the chains 102 to begin downward movement of the cleaning mechanism 12. By virtue of the cleaning mechanism being supported by rollers 88, 96, the bracket 24 tilts toward the window to bring the wiper blade 26 into contact with the window surface (FIG. 8) when the drive wheels pass over to the other side of the chains to begin their downward descent. At the bottom of the tracks, the drive wheels 30, 34 rotate around the bottom of the chains 102 (as depicted by drive wheel 30 in FIG. 9) to begin upward movement of the cleaning mechanism. This causes the wiper blade 26 to be retracted away from the window surface (FIG. 7). Typically, the cleaning mechanism 12 is operated to traverse and clean the exterior of the window in a single up and down cycle, although multiple cycles can be performed if desired.

Figure 14:
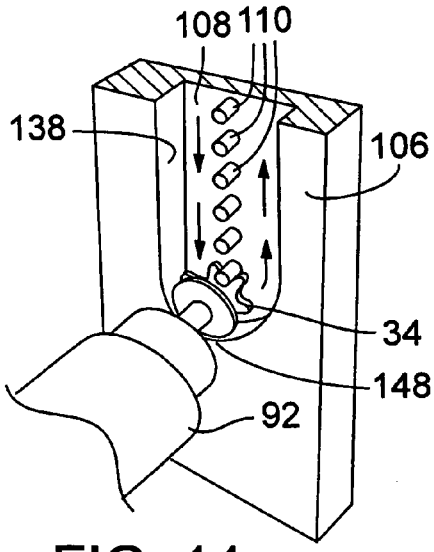
FIG. 14 is a fragmentary perspective view of another embodiment of the track, showing the corresponding drive wheel engaging the track.

FIG. 14 shows an alternative construction of a track, indicated at 106, which can be used instead of tracks 14, 16. The track 106 is formed with a recessed portion 108 extending lengthwise of the track and a plurality of lugs, or pegs, 110 that are equally spaced apart along the length of the recessed portion 108. In particular embodiments, the track 106 has a unitary or one-piece construction with integrally formed lugs 110. This construction can be accomplished, for example, by manufacturing the track 106 from any of various suitable plastics using known techniques, such as injection molding, extrusion, casting, or combinations of these processes. When two tracks 106 are used, end portion 92 of the drive shaft can be provided with a bearing 148 secured thereto and spaced inwardly of the drive wheel 34. The bearing 148 resides in the recess 108 and contacts the elliptical side surface 138 of the recess as the drive wheel 34 traverses the path extending around the pegs 110. Similarly, shaft 74 (FIGS. 9 and 13) can be provided with a washer 148 spaced inwardly of the first drive wheel 30 for contacting the elliptical side surface of the respective track 106. The washers 148 assist in maintaining engagement of the drive wheels 30, 34 with the pegs 100 and therefore minimize "bouncing" of the drive wheels 30, 34 as they traverse the pegs 110.

As shown in FIGS. 1 and 7, the cleaning apparatus 10 can also include a recoil device 120 for storing and dispensing the tubing 86. The recoil device 120 in the illustrated configuration comprises a rotatable spool, or reel, 122 mounted below the window. The spool 122 preferably is mounted inside the window casing below the window or is otherwise hidden from view, such as by mounting a housing over the spool 122. One end of the tubing 86 is connected to an outlet port 128 in the spool 122 (FIG. 7). The spool 122 is spring loaded with a torsion spring or equivalent mechanism (not shown) to resiliently urge the spool to wind up the tubing 86 (as indicated by arrow 124) as the cleaning mechanism 12 moves in the downward direction, thereby removing slack from the tubing. As the cleaning mechanism 12 moves in the upward direction, the spool 122 is allowed to rotate in the opposite direction (as indicated by arrow 126) to dispense the tubing 86.

To supply water to the spool 122, in inlet conduit 130 is connected to an inlet port 132 in the side of the spool 122. In use, water flows into the spool 122 via inlet Port 132 and then into the tubing 86 via outlet port 128. The flow of water to the spool 122 can be controlled by a valve 134, which in turn is connected to the pressurized water source via conduit 136. In particular embodiments, conduit 136 is fluidly connected to a water line of the building on which the apparatus 10 is installed. The valve 134 can be a manual valve, but is more preferably an electrically-activated valve, such as a solenoid valve. Activating or opening valve 134 allows pressurized water to flow to and activate the motor 22 for cleaning the window 18. Conversely, de-activating or closing the valve 134 interrupts the flow of pressurized water to the motor 22 to de-activate the cleaning apparatus.

Figure 15:
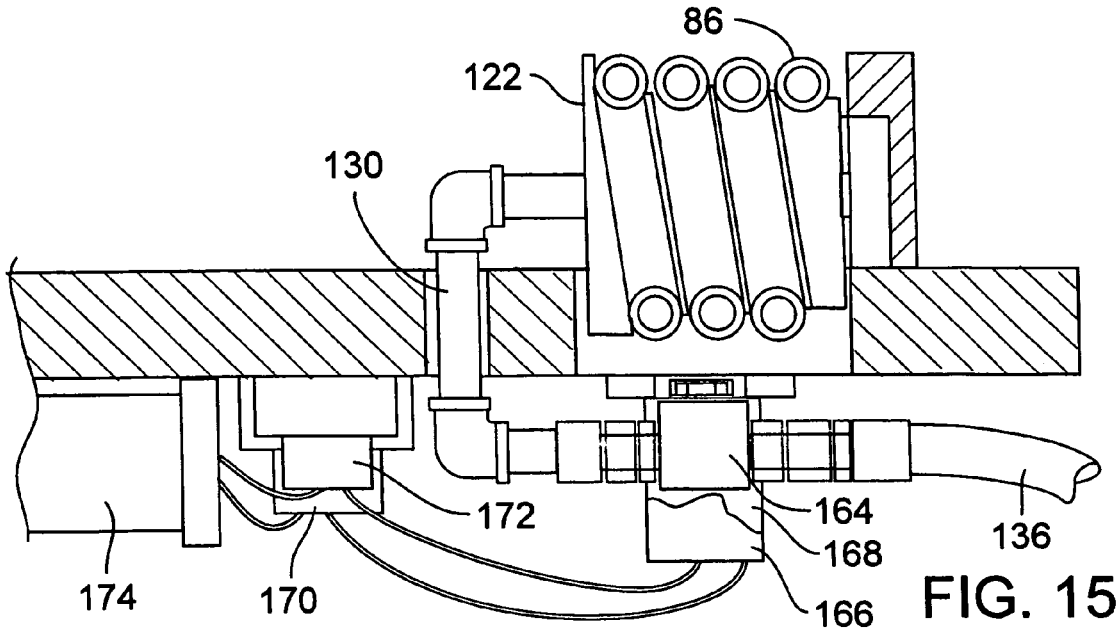
FIG. 15 is a fragmentary sectional view showing the recoil device and the control valve of the cleaning apparatus.

In one implementation, the valve 134 can be actuated by a user using a wire-less remote control unit, which can be, for example, a remote control unit used to control other electronic devices in a "smart" house. As shown in FIGS. 7 and 15, for the example, the valve 134 in the illustrated configuration includes a ball valve housing 164 housing a ball (not shown), first and second motors 166, 168, respectively, mounted on opposite sides of housing 164. Actuation of the first motor 166 rotates the ball in a first direction to open the valve 134 and actuation of the second motor 168 rotates the ball in the opposite direction to close the valve. The first and second motors 166, 168 are electrically connected to first and second controllers 172, 174 (FIG. 15), respectively, which in turn are connected to a power supply 174 (which can be rechargeable batteries). The controllers 172, 174 alternatively can be electrically connected to an electrical circuit of the building. The controllers 172, 174 are operable to receive signals from a wire-less remote control (e.g., an RF remote control) for actuating the motors 166, 168.

The valve 134 also can be automatically controlled by a timer circuit such that the cleaning apparatus 10 is automatically activated at pre-set time intervals (e.g., once a week). The valve 134 also can be a pressure-control valve that is operable to vary the pressure of the water supplied to the motor 22 so as to vary the speed of the cleaning mechanism 12.

In another implementation, water can be supplied to the cleaning apparatus from a tank or storage vessel that is located near the cleaning apparatus or at a remote location. The flow of water from the storage vessel to the cleaning apparatus can be control by an electric pump, in which case valve 134 would be optional.

Figure 16:
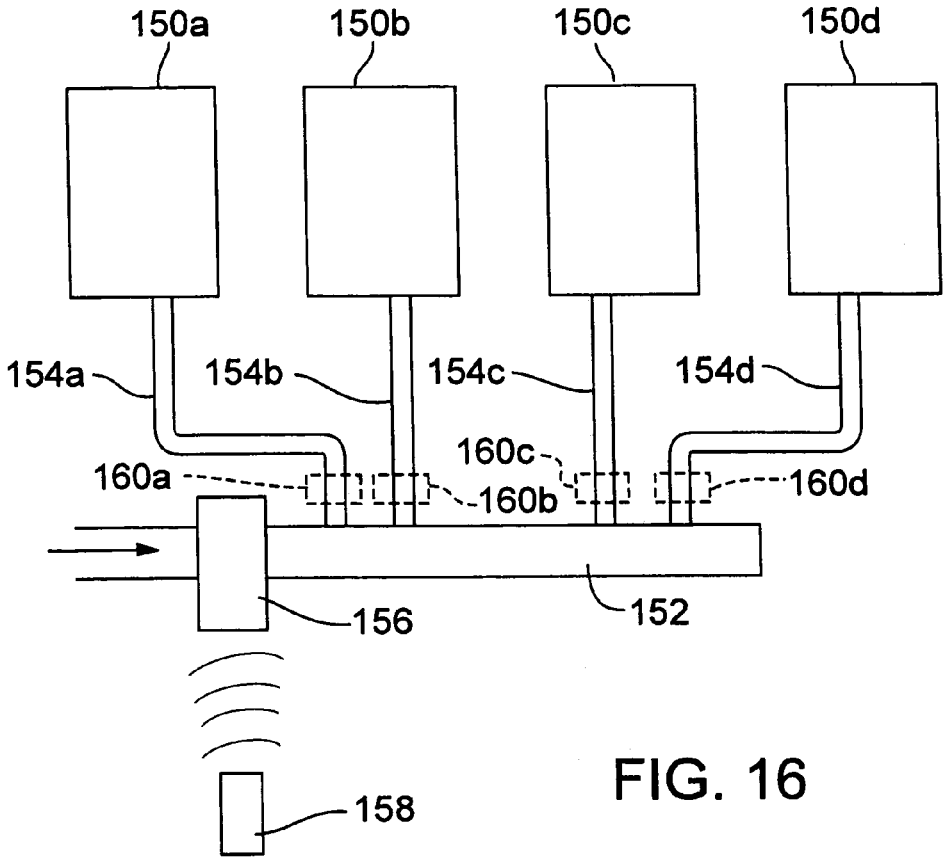
FIG. 16 is a schematic block diagram of a system for controlling multiple cleaning apparatuses installed on the windows of a building, according to one embodiment.

FIG. 16 is a schematic illustration of a system for controlling multiple cleaning apparatuses installed on respective windows 150*a*, 15*b*, 150*c*, and 150*d* of a building. Each cleaning apparatus is fluidly connected to a common manifold 152 by respective conduits 154*a*, 154*b*, 154*c*, and 154*d*. The flow of water into the manifold 152 is controlled by a valve 156, which in the illustrated embodiment is an electronic valve adapted to be controlled by a remote control 158. Thus, activation of the valve 156 with the remote control 158 allows pressurized water to flow to and activate the motor of each cleaning apparatus for simultaneously cleaning each window. Alternatively, the flow of water from the manifold 152 to each conduit 154*a*, 154*b*, 154*c*, and 154*d* can be controlled by a respective valve 160*a*, 160*b*, 160*c*, and 160*d*. Each valve 160*a*, 160*b*, 160*c*, and 160*d* can be selectively activated by the remote control 158 to clean one or more of the windows 150*a*, 150*b*, 150*c*, and 150*d*. The system also can include a hard-wired control panel (not shown) which can be operable to control the valves via user input and/or can be operable to receive input signals from the remote control for operating the valves.

Figure 19:
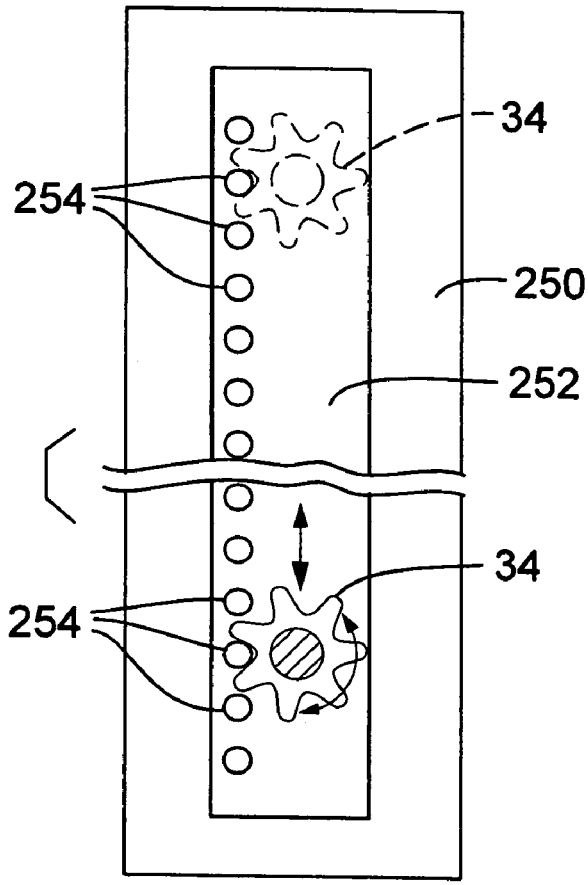
FIG. 19 is a side elevation view of a track that can be used with a cleaning mechanism having the hydro-mechanical motor shown in FIGS. 17 and 18.

In another embodiment, the cleaning mechanism 12 includes a hydro-mechanical motor 200 (FIGS. 17 and 18) that can transmit rotational movement in two directions to the drive wheels 30, 34 for moving the cleaning mechanism 12 upwardly and downwardly relative to the window 18. Because the motor 200 is "reversible," the cleaning mechanism 12 in this embodiment can be used with two tracks 250 (one of which is shown in FIG. 19) that allow for movement of the cleaning mechanism along a straight path. As shown in FIG. 19, track 250 is formed with a recess 252 extending lengthwise of the track and a plurality of longitudinally-spaced pegs 254 disposed in the recess 252. Drive wheel 34 can traverse the pegs 254 in first and second, opposing directions (upwardly and downwardly in the illustrated embodiment) along a straight path defined by the recess 252.

Figure 17:
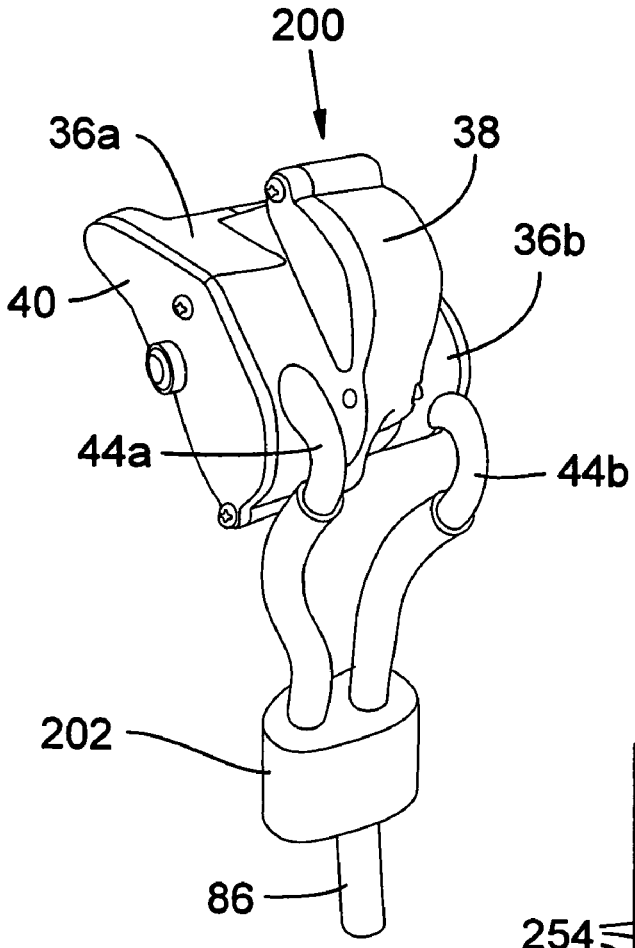
FIG. 17 is a perspective view of a hydro-mechanical motor, according to another embodiment, that can be operated to rotate the drive wheels in two directions.
Figure 18:
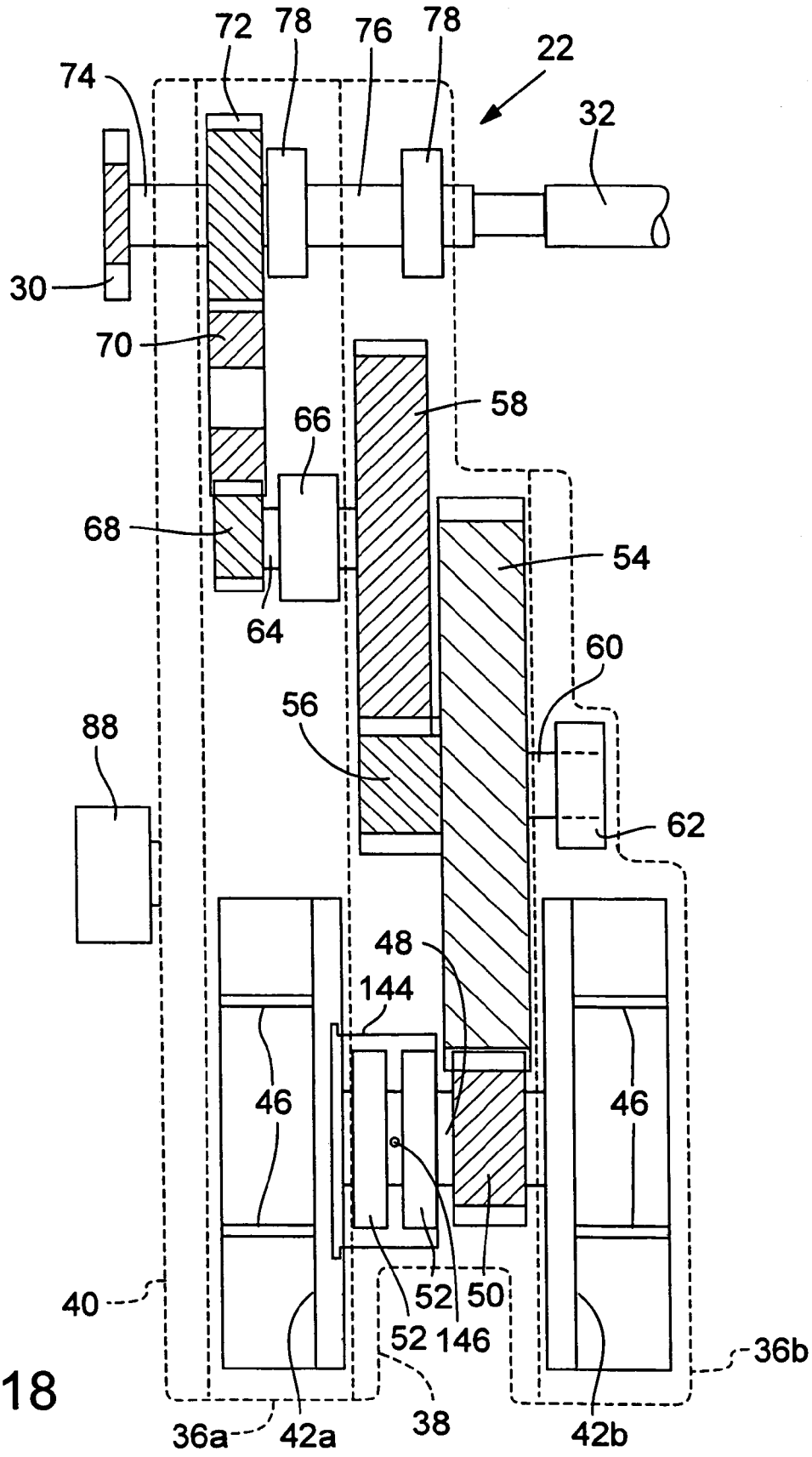
FIG. 18 is an enlarged sectional view of the motor shown in FIG. 17.

The motor 200 has many of the same components as the motor 22 (FIGS. 10-13), and therefore the same respective reference numerals are used to describe like parts of the motor 200. As shown in FIGS. 17 and 19, the motor 200 includes a first casing portion 36*a*, a second casing portion 38, and a third casing portion 36*b*. The first casing portion 36*a* and the second casing portion 38 include all of the same components as casing portions 36, 38 of motor 22 shown in FIG. 13. The impeller 42*a* housed in the first casing portion 36*a* is connected at one end of a shaft 48 that extends into the third casing portion 36*b*. The third casing portion 36*b* houses another impeller 42*b* that is secured to the end of the shaft 48 opposite the impeller 42*a*. Rotational motion of the impellers 42*a*, 42*b* is transmitted to the drive wheels 30, 34 via the gears housed in the motor.

The first casing portion 36*a* has a water inlet 44*a* (FIG. 17) for introducing pressurized water into the first casing portion and causing rotation of the impeller 42*a* housed therein. The second casing portion 36*b* has a water inlet 44*b* (FIG. 17) that introduces pressurized water into the second casing portion in a direction that causes the impeller 42*b* to rotate in an opposite direction from the rotation of impeller 42*a*. Both inlets 44*a*, 44*b* are connected to a switching valve 202, which in turn is connected to tubing 86. Switching valve 202 (which can be a spring activated valve) is operable to control the flow of pressurized water from tubing 86 into either inlet 44*a* or inlet 44*b*.

When water is allowed to flow into inlet 44*a*, the impeller 42*a* in the first casing portion 36*a* is caused to rotate, moving the cleaning mechanism 12 in a first direction along tracks

250 (upwardly in the illustrated embodiment). When water is allowed to flow into inlet 44*b*, the impeller 42*b* in the second casing portion 36*b* is caused to rotate in the opposite direction, moving the cleaning mechanism 12 in a second direction along the tracks 250 (downwardly in the illustrated embodiment). To activate the switching valve 202 (and reverse the rotation of the motor 200), limit switches or equivalent mechanisms can be positioned at the bottom and top of the tracks 250 for switching the position of the switching valve 202 (and re-directing the flow of water) whenever the motor 200 reaches the top and bottom of the tracks.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A window cleaning apparatus for cleaning a window, comprising:

at least one cleaning tool mounted for movement relative to the window;

a hydro-mechanical motor operatively connected to the cleaning tool and being configured to receive pressurized water from a water source and derive output power from the pressurized water such that when the motor is fluidly connected to the water supply, the motor provides output power to cause the cleaning tool to move relative to the window for cleaning the window;

wherein the motor is coupled to the cleaning tool such that the motor and the cleaning tool can move together relative to the window when pressurized water is supplied to the motor;

first and second tracks mounted on opposite sides of the exterior of the window;

a first drive wheel coupled to the motor and configured to movingly engage the first track;

a second drive wheel configured to movingly engage the second track; and a drive shaft having a first end coupled to the motor and a second end coupled to the second drive wheel;

wherein when pressurized water is supplied to the motor, the motor causes rotation of the first drive wheel, the drive shaft, and the second drive wheel, thereby causing the drive wheels to move relative to the first and second tracks, thereby moving the motor and the cleaning tool relative to the window.

2. The apparatus of claim 1, wherein the motor has a water inlet that receives pressurized water from the water source, and a water outlet that is adapted to discharge water across a surface of the window for cleaning the window.

3. The apparatus of claim 2, wherein the at least cleaning tool comprises a squeegee and a brush, and the water outlet is adapted to discharge water across a surface of the window between the squeegee and the brush.

4. The apparatus of 1, wherein:

the first and second tracks are vertically oriented; and wherein when pressurized water is supplied to the motor, the motor and the cleaning tool can move upwardly and downwardly relative to the window.

5. The apparatus of claim 1, wherein:

the at least one cleaning tool comprises a squeegee; and the motor and the squeegee are configured to move in first and second, opposing directions relative to the window such that when the motor and the squeegee move in the first direction, the squeegee is brought into contact with the window surface, and when the motor and the squeegee move in the second direction, the squeegee is retracted away from the widow surface.

6. The apparatus of claim 1, wherein the motor comprises:

an impeller configured to rotate when pressurized water from the water source is supplied to the motor; and a speed reducer configured to transmit rotational motion of the impeller to the first drive wheel and the drive shaft at a reduced rotational speed.

7. The apparatus of claim 1, wherein:

each of the first and second tracks comprise a plurality of stationary lugs spaced lengthwise of the tracks; and the first and second drive wheels are configured to movingly engage the lugs of the first and second tracks, respectively.

8. The apparatus of claim 7, wherein:

the first drive wheel can move relative to the first track in an endless path extending around the lugs of the first track;

the second drive wheel can move relative to the second track in an endless path extending around the lugs of the second track; and movement of the drive wheels along their respective paths moves the motor and the at least one cleaning tool in a first direction relative to the window and then in a second, opposite direction relative to the window.

9. The apparatus of claim 8, wherein when the drive wheels move the motor in the first direction, the motor is caused to assume a first position to bring the at least one cleaning tool into contact with the window surface, and when the drive wheels move the motor in the second direction, the motor is caused to assume a second position to retract the at least one cleaning tool away from the window surface.

10. The apparatus of claim 1, further comprising:

a flexible conduit connected to the motor and adapted to supply pressurized water from the water source to the motor; and a recoil device having a rotatable spindle, the recoil device being operable to wind at least a portion of the conduit around the spindle to remove slack from the conduit as the motor moves in a first direction and to dispense the conduit from the spindle as the motor moves in a second direction, opposite the first direction.

11. The apparatus of claim 1, further comprising:

a shut-off valve operable to fluidly connect the pressurized water source to the motor and to fluidly disconnect the pressurized water source from the motor; and a wire-less remote control operable to control the operation of the shut-off valve.

12. The method of claim 1, wherein the tracks are stationary and the first and second drive wheels move along the length of the first and second tracks, respectively.

* * * * *